United States Patent [19]

Sundhauss

[11] 3,978,179

[45] Aug. 31, 1976

[54] PRODUCTION OF NON-WOVEN FABRICS

[75] Inventor: Hermann O. Sundhauss, Lexington, Mass.

[73] Assignee: Reprocess Textile Associates, Lexington, Mass.

[22] Filed: Sept. 4, 1973

[21] Appl. No.: 393,786

[52] U.S. Cl. ..... 264/37; 241/24; 241/29; 264/109; 264/116; 264/122; 264/140; 264/300

[51] Int. Cl.[2] ..... D04H 1/12; D04H 1/54; D04H 5/06

[58] Field of Search ..... 264/37, 109, 122, 115, 264/116, 118, 126, 140, 300; 241/13, 24, 29, 27

[56] References Cited

UNITED STATES PATENTS

| | | | |
|---|---|---|---|
| 2,433,727 | 12/1947 | Arnold | 264/140 |
| 2,516,295 | 7/1950 | Borton et al. | 264/140 |
| 2,543,101 | 2/1951 | Francis | 264/122 |
| 2,779,974 | 2/1957 | Billing et al. | 264/115 |
| 2,808,098 | 10/1957 | Chavannes | 264/122 |
| 3,309,441 | 3/1967 | Burczyk et al. | 264/140 |
| 3,328,188 | 6/1967 | Heberlein | 241/15 |
| 3,428,260 | 2/1969 | Feder | 241/15 |
| 3,595,485 | 7/1971 | Dunbar | 241/16 |
| 3,648,937 | 3/1972 | Ehrreich | 241/15 |
| 3,671,615 | 6/1972 | Price | 264/115 |

OTHER PUBLICATIONS

Potter et al., Fiber to Fabric, Gregg, N.Y. (1965), pp. 4–7 relied on.

*Primary Examiner*—Willard E. Hoag
*Attorney, Agent, or Firm*—Sewall P. Bronstein; David G. Conlin

[57] ABSTRACT

Process for the production of non-woven textile fabric from non-woven fabric waste material in which the waste is mechanically reduced to a particle size of less than three-fourth inch, preferably less than one-half inch and more preferably to a size of three-sixteenth to three-eighth inch, and reused, preferably as a blend with fibers (e.g., virgin or conventionally reclaimed) three-fourth inch or greater in length, to form the non-woven fabric. Addition of binding material other than that already contained in the waste is normally not necessary.

Process for recycling and reclaiming non-woven textile waste by mechanically reducing the size of such waste by mechanically reducing the particle size of the fabric waste to less than three-fourth inch, preferably by first cutting it with cutters and then hammer milling the cut waste in a hammer mill having a sized screen through which the hammered cut waste is forced.

A non-woven textile fabric containing at least 25% and as high as 98% by weight of mechanically reclaimed non-woven waste, the particle size of which has been mechanically reduced to less than three-fourth inch, preferably less than one-half inch, and fibers which are other than non-woven fabric waste and which have a fiber length of three-fourth inch or greater.

13 Claims, 2 Drawing Figures

PRODUCTION OF NON-WOVEN FABRICS

DESCRIPTION OF THE INVENTION

This invention relates to novel method and apparatus for production of non-woven fabric from fibrous non-woven fabric waste materials which have been reclaimed by mechanical reduction to relatively small particle size, to the fabric so produced and containing the reclaimed waste and to the method for reclaiming such waste.

Thus the invention relates to reduction in size of relatively large pieces of fibrous materials to relatively small sizes so that they can be reprocessed to form a continuous non-woven fabric.

The textile industry, especially the non-woven textile industry, disposes of a substantial amount of non-woven waste fabric material which is accumulated from various stages of the manufacturing process, such as trimmings, end pieces, faulty sections, experimental pieces and rejected pieces. At the present time, practically none of these non-woven waste materials are reclaimed or reused to produce non-woven fabrics because there has been no satisfactory method of reclaiming or reusing them. Rather, they are disposed of in refuse dumps or by chemical or physical means, and as so disposed they constitute environmental pollutants. Furthermore, a large portion of marketed non-woven fabric materials, which are ultimately discarded as waste and pollutants, would be suitable for reuse if a practical method of reprocessing or reclaiming these materials were available, but no such method is presently available.

The concept of reusing or reclaiming non-woven fibrous textile waste materials has been around for several years, but no process has been available by which a useful end product can be obtained within economical restrictions. For example, chemically dissolving the waste materials and then forming fibers or films has been tried, but without success. In the case of chemically bonded non-wovens (i.e., those containing resin binders, such as acrylic or vinyl resins, to bind the non-woven fibers together to strengthen the fabric), which includes most of the non-woven fabrics, attempts have been made to remove the binder and free the fiber material so that the individualized fibers can be reformed into a continuous web to produce a reclaimed non-woven fabric. These attempts have failed, primarily because of the cost of reprocessing involved, and also because of the sophisticated technology required to treat the wide variety of existing non-woven fabric wastes in the different ways necessary to eventually obtain a satisfactory non-woven fabric. So far, most proposed solutions to the problem have not passed beyond a purely experimental stage.

It is believed that one of the difficulties in successfully reclaiming non-woven fabric waste has been the large amounts of resin binder present in the fabric (normally from 25 to 30% by weight of the fabric), coupled with the fact that the fibers themselves are usually synthetic resin fibers, such as polyesters, rayon, nylon, acrylic resins, etc., and the belief that such binder must be chemically removed or dissolved to somehow reproduce individual fibers.

An object of the invention is to provide a process for the economical production of a commercially acceptable non-woven textile fabric containing reclaimed non-woven textile fabric waste.

Another object of the invention is to provide an economically and commercially accepted non-woven fabric which is made up in substantial part of reclaimed fibrous non-woven textile fabric waste.

Another object of the invention is to provide an economically feasible process of reclaiming non-woven textile fabric waste to make it suitable for producing commercially accepted non-woven fabric, thereby removing such waste as a pollutant source and at the same time providing an inexpensive raw material for making useful non-woven fabrics.

Yet another object is to reclaim such waste fabric without chemically removing or dissolving the binder (i.e., without the necessity of freeing the fibers from the binder); rather the binder remains with the fiber and facilitates processing and can be used as the binder for the ultimate non-woven fabric made from such reclaimed waste to thereby reduce the cost. In fact, the continued presence of the binder, as such, is believed to be beneficial to the reclaiming process of the invention and to the web formation of the ultimate non-woven fabric.

Another object is the provision of an economically feasible process by which a wide variety of non-woven fibrous fabric wastes containing a wide variety of binders and fibers may be converted into raw material for non-woven fabric.

These, and other objects and advantages, which will be apparent from the following description, are attained through the present invention, by mechanically reducing the size of the non-woven fabric waste to a particle size range from about 2/32 inch or 3/32 inch to less than about ¾ inch (preferably less than about ½ inch). In a preferred embodiment this is done by first cutting the waste fabric into smaller pieces and then hammer milling the cut waste into smaller pieces and individualized fibers.

Preferably, the waste material is treated with a conventional textile lubricant and anti-static agent prior to size reduction, to decrease heat build-up and adherence of the small particles to the size reduction equipment due to build-up of static electricity and to frictional effects.

Also, certain surfaces of the equipment are preferably coated with a slippery material of low coefficient of friction to prevent sticking of the reduced sizes of the waste to the equipment, which is apt to cause plugging.

Thus, the process of the invention involves reducing the physical size of a coherent fibrous assembly to a convenient size so that the material can be reprocessed to produce useful products. The material is reduced to desired size by mechanical means. For example, cutting, crushing and/or hammering can be utilized for this purpose. In cutting, the material is sheared between two sharp edges; machines that are so equipped with cutter knives are suitable. Size reduction equipment, such as cutting and milling equipment, which have previously been used to reduce size in the food, chemical, plastic, animal feed, leather and other industries may be used or be modified for use in reducing the size of the non-woven textile waste fibrous materials.

Preferably, the size reduction is accomplished in at least two stages, the material being first reduced by one or more steps, e.g., cutting to an intermediate size during a first stage, and then in one or more steps, e.g., hammer milling during a second stage, to the desired size range.

Once reduced in size, the material may be combined with other fibers, i.e., fibers other than non-woven fabric waste, such as virgin or conventionally reclaimed fibers, preferably in the form of individual fibers free from binder and ¾ inch or greater in length, to make the non-woven fabric.

One of the advantages of this invention is that it mechanically reduces the size of the non-woven waste fabric material into any desired size. The user can select a size of material which is suitable for his particular type of processing and end use application. Since the process is mechanical, the chemical mixture of the input waste material can be any available textile fiber such as nylon, polyester, acrylic, rayon, acetate, wool and cotton, and any conventional binder.

Another important advantage of this invention is that the cost of processing of the waste material into a reformable and reusable stage is extremely low. One reason for this is because the machinery involved has been proven over many years and operates at high productivity level with high efficiency. The cost of raw material is negligible since waste materials do not carry much value; in fact, it costs to dispose of most non-woven waste materials.

Therefore, another advantage of the process is to enable the manufacturer of non-woven fabric to reduce the cost of his ultimate product by adding reclaimed material.

The reprocessed or reclaimed material can be used in a variety of forms. It can be used in 100% form or it can be mixed with other materials at different levels depending upon the economics and properties desired in the ultimate product.

For the purposes of this description, reference is made to the accompanying drawing, in which.

Figure 1:
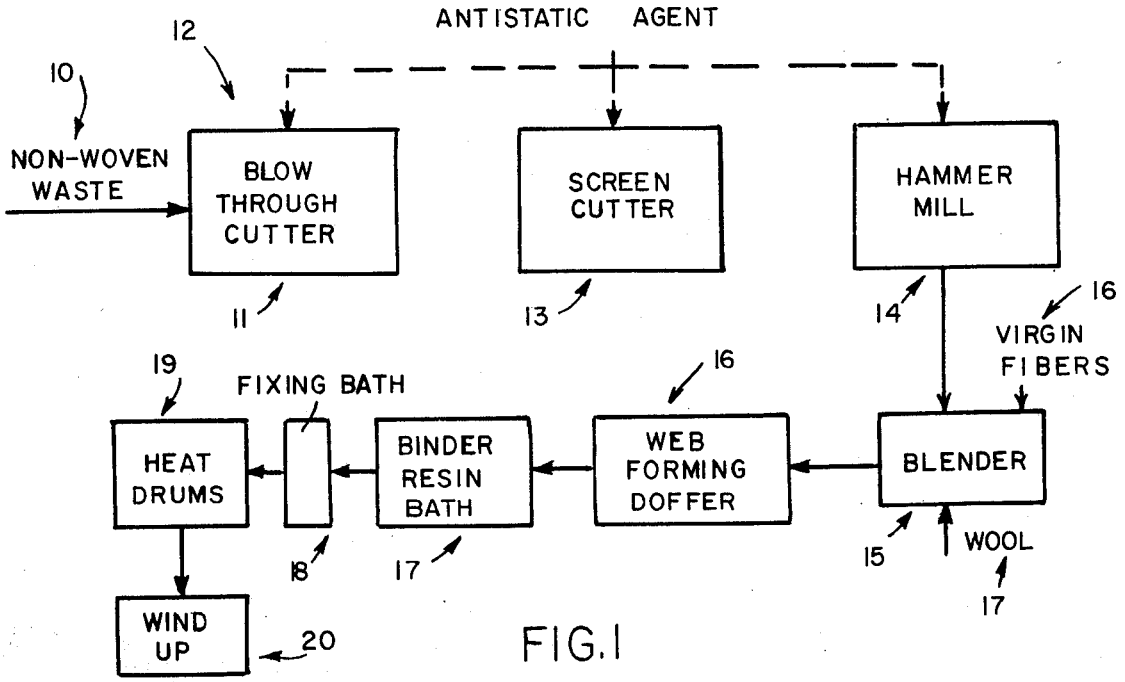
FIG. 1 is a schematic depiction of the various states of treatment utilized in one embodiment of the invention.

In the embodiment depicted in FIG. 1, non-woven fabric waste 10 (the commercial trimmings of a polyester-nylon-rayon blend non-woven fabric containing 25–30% of polyacrylic binder) is first put through a blow-through cutter 11 (the particular blow-through cutter which has been used is a Sprout Waldron BT8-6 Blow Through Cutter but other conventional blow-through cutters can be used), which reduces the waste fabric to pieces in the range of 1½ to 2 inches. At this first cutting stage a conventional anti-static agent is applied by spraying it onto the waste fabric material to wet it. The anti-static agent prevents build-up of electrostatic charge and reduces friction between the waste particles and between such particles and the size reduction equipment to thereby prevent plugging. Unless charge build-up is prevented and frictional forces are reduced the reduced size waste material, particularly during subsequent processing in the hammer mill where the waste is reduced in size to small particles, may adhere to the components of the machine rather than transferring through the machine, thereby causing plugging.

The type, chemical nature and the amount of the anti-static agent used in the process will depend upon the raw materials used and the atmospheric conditions. Any conventional textile anti-static agent known in the art may be used, such as propionamides, sulfonates, sulfonated and sulfated esters, oils, sulfonated and sulfated oils, ammonium sulfide ester compounds, surfactant aldehyde mixtures, phosphate esters, etc., in conventional amounts. A typical anti-static solution usable in the process is an aqueous solution of 8% by weight of a soluble self-emulsifying mineral oil sold under the trademark Sulfol 448 by E. F. Houghton & Company and 4% by weight of a similar oil sold under the trademark Antistate 575, also by E. F. Houghton & Company, in 88% by weight of water.

The amount of anti-static agent added may range from 0.1–5% preferably 0.2 to 2 or 3%, of the dry agent based on dry weight of waste fibers or from ½ to 12% of the aqueous solution based on dry weight of the fibers. Normally, the material will not require additional anti-static agent during subsequent processing, but it may be added later if desired.

From the blow-through cutter 11, the non-woven waste goes to screen cutter 13 (this may be a Sprout-Waldron MR 20 × 30 Cutter, which together with the blow-through cutter 11 is shown in the Sprout-Waldron Bulletin 1000 submitted with this application, but any conventional screen cutter may be used) having a screen size of ¾ inch, which further reduces the size of the waste fabric to approximately ¾ inch. This type of equipment comprises rotating cutters passing through the waste fabric pieces to cut and shear them and to throw the cut waste against a screen sized to permit particles of the desired size to pass through, thereby controlling the cut size.

Figure 2:
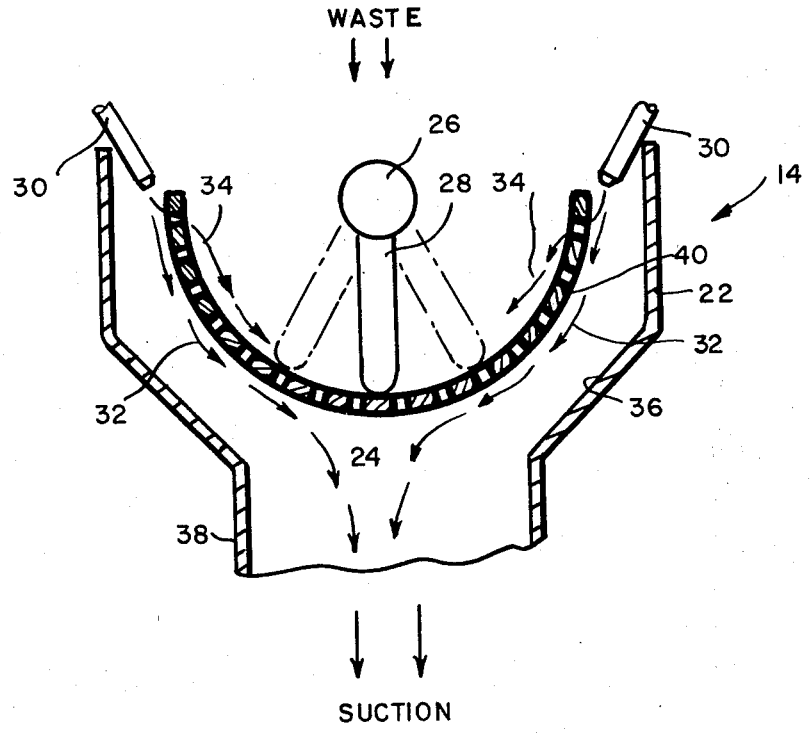
FIG. 2 is a diagrammatic cross section of the hammer mill 14 of FIG. 1.

The final reduction in size to a range of from 3/16 to ⅜ inch takes place in the hammer mill 14. Although any conventional hammer mill with screen may be used an apparatus suitable for this step is the Sprout-Waldron CG hammer mill, also made by Sprout, Waldron & Co., Inc. and referred to in Sprout-Waldron Size Reduction Bulletin 1230 submitted with this application. A diagrammatic view of part of this equipment is shown in FIG. 2. In that equipment and with reference to FIG. 2, hammers 28 rotate on shaft 26 to hammer (and thereby reduce the size of) the cut waste within the casing 22 against a sized screen 34 until it is small enough to pass through the screen. The small waste particles 3/16 to ⅜ inch in size (the screen size is ⅜ inch) are sucked through the screen by a suction applied to outlet 38. The hammering action involves crushing, cutting, tearing and shearing of the already cut waste.

Some modifications to the Sprout-Waldron hammer mill are made in order to insure against clogging of the screen by static electricity, friction and build-up of heat in the material and to insure against softening of the non-woven waste (either the thermoplastic resin binder or the synthetic resin fibers) by such build-up of heat. The processed material has shown a tendency to soften because of the heat generated during hammering. The softened material becomes stretchy and may stick to the machine components. Most textile materials have softening temperatures between 150° to 250°F. The binders that are used to hold the fabric together usually soften at lower temperatures than the fibers; for example, the softening temperature range for most binders may be between 90° and 200°F. The effect of the temperature generated in the system on the material becomes worse as the size of the material gets smaller because of the increased surface area.

In order to prevent the material from sticking onto the screen and to prevent heat build-up two steps may be taken, in addition to the use of anti-static agents.

The screen 24 may be coated with a slippery, low friction material 40, such as polytetrafluoroethylene or silicone or Kel F (difluoro dichloro ethylene) to reduce friction and static build-up. The converging casing wall 36 may also be so coated to reduce sticking of the small non-woven waste particles thereto. Also, pressurized (compressed) air may be directed from a plurality of pressure nozzles 30 onto the upstream and downstream surfaces of the screen along the width of the screen. The air pressure may be in the order of 60 psig (it may vary between 30 and 90 psig although the particular pressure is not critical). The air is cooled down to between 30° and 50°F by release of pressure at the nozzles 30 to absorb heat generated in the process and thereby cool the waste and the equipment. The compressed air may be refrigerated to provide lower temperatures — as low as 0°F — if desired, or the temperature of the compressed air may be higher than 50°F, e.g., 70° to 80°F. The pressurized air also helps to create turbulence in the vicinity of the screen surface and thus promote the passage of the material through the screen to avoid plugging the screen. It is noted that nozzles 30 are so located that most of the compressed air is blown along the downstream screen surface to clear it but some of the air also passes through the screen from the nozzles and is blown along the upstream screen surface. The waste material and hammer mill equipment may be cooled and the waste particles agitated at the screen surfaces by conventional means other than compressed air.

The suction (by a suction pump not shown) conventionally applied to the downstream side of the screen in this type of hammer mill sucks the reduced size particles (reduced in size by the action of the hammer mill) through and away from the screen and out of the hammer mill. The magnitude of the suction preferably is in the order of 1800 cubic feet per minute.

The screen of the screen cutter 13 may also be coated with the same or different slippery material of low coefficient of friction if required. Also compressed air may be applied to the cutter screen.

The size of the particles of non-woven waste material that is put out by the hammer mill can be controlled by means of selecting an appropriate screen size (also to some extent by regulating the hammer action, e.g., the design of the hammers, the speed of the hammers, the magnitude of the suction, etc.). Both the screen cutter and the hammer mill provide an output material which has a size distribution rather than all the particles being the same size. This is because it is difficult to precisely control the effect of cutting or hammering on material with presently available equipment. However, the bulk of the particles are of a size equal to the screen size and less.

A substantial reduction in size is important because of the coherent nature of the non-woven waste particles. Under a magnifying glass these particles are, in part, individualized fibers broken away from the fabric pieces, but, in the most part based on weight and volume, are small pieces of deteriorated, mangled and broken fabric (in the most part 3/16 to ⅜ inch — under ¾ inch — in size) with frayed edges of protruding fibers and with missing fibers broken away therefrom (these conditions are probably caused in large part by the hammering action). The small pieces of fabric may be described as agglomerates of fibers held together by the binder originally in the non-woven waste. These agglomerates tend to hinder uniformity in the final non-woven fabric made from the waste if not controlled in size. If they are too large, uniformity of the final product is detrimentally reduced regardless of the method of processing. It has been found that when the final reduced waste fiber size reaches a size of about ¾ inch or greater, lumps or noils of undesirably large size commence to form in the final non-woven fabric by the oversized pieces, thereby reducing its uniformity and hence its quality. Accordingly, the bulk, and preferably all, of the waste should be less than ¾ inch, more preferably less than ½ inch, to avoid any substantial occurrences of these lumps. However, it will be understood that small numbers of the waste pieces may be slightly oversized. Since the occurrence of the noils or lumps in the end product is caused by the presence of oversized waste particles it will be understood that if a small noil population is acceptable small amounts of the reduced waste may be oversized, the maximum acceptable amount of such oversized particles depending upon the magnitude of the noil population which is acceptable. However, it is best to avoid any oversized pieces to achieve a uniform high quality fabric. On the other hand, if the cut fibers are below about 2/32 or 3/32 inch, they will tend to fall out of the dry laid non-woven web during formation thereof and to reduce the strength of the final non-woven fabric product, presumably because of the decreased interlocking of the fibers. The undersized waste also has a greater tendency to clog the cutter and hammer mill screens and to soften because of the heat generated in that equipment. The size range of the non-woven waste which leads in most cases to strong, uniform non-woven fabric is from 3/32 inch to less than ½ inch (preferably 5/32 to 7/16 inch), the best results being obtained with particles of 3/16 inch to ⅜ inch.

Although particles sizes below 2/32 or 3/32 inch are detrimental to the process, nevertheless, it is difficult to altogether avoid undersized particles (this is more difficult than it is to avoid oversized particles) and small amounts thereof in the nature of 1 to 7% or 10% by dry weight of the reduced waste are acceptable. Where the final non-woven fabric is wet laid a substantially greater amount of the reduced waste may be less than 3/32 inch in size.

Particle size of the reduced waste, as used herein, refers to the maximum dimension of the small frayed deteriorated and mangled irregularly shaped pieces of fabric in the case of such pieces. In the case of fibers in the waste which have been individualized by the cutting and hammering, the lengths thereof will also usually be less than ¾ inch or ½ inch due to the hammering and cutting action but it is not detrimental, in fact it is beneficial, if these individualized fibers are larger than that, e.g., ¾ inch to 1½ inch or even greater. Such maximum dimension of the pieces of fabric is usually the maximum flat dimension thereof, i.e., most of these pieces of agglomerated fibers are relatively flat like the waste fabric from which they are produced with a length and width greater than their thickness. In the case of most of the fiber agglomerate particles the dry or water laid structure of the fibers can still be observed although much the worse for wear and tear and with fibers missing from the structure, leaving spaces. However, in the case of other particles of fiber agglomerates such dry or water laid lattice structure is not so readily observed. In any event, most of the agglomerate pieces have broken fibers protruding therefrom and the mass is fluffy in nature.

While use of the blow-through cutters lessens the cutting loads on the screen cutter and the hammer mill, operations with only the screen cutter and the hammer mill have proved entirely acceptable. Where only these machines are used, the material is sprayed with anti-static agent in the screen cutter (the anti-static agent may be added other than by spraying), although an addition of such material may also be made in the hammer mill or in the hammer mill alone.

In blender 15 the output from the hammer mill 14 is blended with virgin or other non-waste fibers, i.e., other than non-woven fabric waste, such as conventionally reclaimed fibers (these fibers, as well as virgin fibers, are free from binder and hence exist primarily as individual fibers of the type conventionally used in producing non-woven fabrics) are added in amounts depending on economics and on the properties desired in the final product (the use of 100% of such longer fibers will give a conventional non-woven fabric but will not provide the advantages of the invention). The preferred range of virgin or other non-waste fiber content is about 2–40, more preferably 2–30%, by weight to provide a blend containing from 60 to 70 to 98% non-woven waste. These fibers increase the strength of the final non-woven fabric. Unlike the reduced waste fiber, there is no critical upper limit to the length of the virgin fibers. As a practical matter, however, the length of the virgin fiber employed will run from ¾ inch to 8 inches; it is preferred to use a size range of greater than ¾ inch to 1½ or 2 inches. The bulk of these fibers is preferably over ¾ inch in length. Again, some may be less than ¾ inch in length but the strength of the final fabric decreases accordingly.

Preferably, 0.01 to 5%, more preferably 0.3 to 2% (½% with 8% virgin fibers and 91.5% reduced waste has given good results) by weight of wool, or other fiber, which has a rough scaly or other high friction surface, may also be added to the reduced waste fibers and virgin fibers in blender 15. The addition of such fibers results in a smoother and more uniform final web but it is not critical.

Preferably the virgin or conventionally reclaimed fibers of greater fiber length are synthetic fibers, such as polyesters, nylon, rayon, acrylics, polypropylene, polyethylene, etc., but cotton and wool can also be used.

Having thus obtained the blend of fibrous materials, the method of and apparatus for forming the non-woven fabric therefrom are those conventionally used to form such fabric from virgin or other individualized fibers. Thus the blend is fed to a conventional dry non-woven web forming apparatus 16, which may be a Rando Webber made by Curolator Company, thence to the conventional resin bath 17 for the addition of binder (e.g., conventional solution of acrylic or vinyl or other conventional binder resin in conventional amounts), if necessary, thence (after passage through squeeze rolls) to the conventional fixing bath 18 (e.g., aluminum sulfate or other flocculating agent to flocculate or fix the binder on the fibers), thence to conventional heated drums 19 where the binder is activated and the fabric is dried, and the finished fabric is then wound on a roll at 20.

One distinct advantage which has been found to flow from the present invention is that the resin binder present in the reduced waste fibers is sufficient to function as an adequate binder in the final fabric to hold the web together without adding further resin binder at resin bath 17. This effect is lessened, however, when large amounts of very small reduced waste fibers are used. Accordingly, the resin binder bath and fixing bath may be dispensed with, in many instances. In such case the thermoplastic binder in the waste is activated by the heating rolls to bind the fibers together. Since the normal amount of binder resin is 25–30% by weight (it can vary from 5–50%) of the non-woven fabric and since the amount of non-woven waste in the completed fabric may be as high as 98%, it can be seen that the resin in the waste is adequate as a binder for the final non-woven fabric. However above 45 or 50% of the binder in the final fabric gives a fabric the nature of which becomes no longer fibrous, but rather is more like a plastic sheet having fibers embedded therein. Moreover, use of binder above that amount is uneconomical and gives an undesirably heavy sheet.

Basically, there are three types of non-wovens: those made by a dry-laid process such as that utilized in the aforesaid Rando Webber, made by Curolator Company; those made by a wet-laid process such as in paper making equipment; and those made by a spun bonding process. Non-woven waste made by any of these methods is suitable to be reused in accordance with the present invention. Further, the reduced waste of the present invention can be made into non-woven fabric by using any of these methods. Where the wet-laid process is used, the tendency of very small particles to fall out of the web is reduced so that more of the reduced waste particles may be less than 3/32 inch in size.

In order to incorporate strength and integrity into the fabricated web of fibers they may be bonded mechanically, such as in needle punched fabrics, but in most cases the bond is chemical, using resin binding agents, as aforesaid. Suitable resin binding agents are well known, and include butadiene acrylonitrile, carboxylated-styrene-butadiene, polyvinyl chloride, polyurethane, etc.

The present invention is applicable to any of the conventional synthetic fiber non-woven wastes, including the polyesters, viscoserayon, nylon, acrylics (also modified acrylic), polypropylene, polyurethane, and polyethylene, as well as natural fiber non-woven wastes, such as cotton and wool. In most cases the non-woven fabric wastes contain blends of these fibers.

Most non-woven materials, i.e., fibers and substrates, are chemically polymers. These polymers, when used as non-wovens in apparel or in industrial applications are designed to be relatively soft like a clothing material. Therefore it is relatively convenient to mechanically reduce the size of practically all non-woven materials of polymer base.

Also, to achieve desired effects, other materials may be blended with the reduced waste, such as from 0 to 10% by weight of ground polyurethane or other resin foams of a particle size about the same or even smaller than the reduced waste. Also wood pulp, rubber, silica, etc., may be used as fillers.

Since the non-woven waste utilized in the invention has no present market and is normally dumped, the more of this which is included in the final non-woven fabric the less the cost and the greater the reduction in pollution caused by dumping the waste. Accordingly, in this respect, the more waste which is included in the blend the better unless special properties are desired (e.g., a stronger fabric) calling for less waste. Thus a fabric containing 98% waste, which is almost all waste, is desirable from this point of view. On the other hand, beneficial effects are achieved in cost and reduction in pollution even if only 20 or 30%, e.g., 25%, or even less of the final fabric is made up of the waste. The minimum amount is dictated only by that amount which is so small that it does not warrant the added cost of reducing the particle size thereof as compared to using 100% virgin or conventionally reclaimed fibers. When the amount of waste is reduced to below a certain amount, binder resin must be added to the final non-woven web, the less the waste below this amount the more the resin which must be added.

The surprising part of the present invention is that if conventional individualized virgin or conventionally reclaimed fibers are used and reduced to the small size of the reduced waste, such small sizes would present processing problems during size reduction, would substantially weaken the resulting fabric and would tend to fall out of the web during dry-laying of the fibers. As aforesaid, the binder already in the non-woven waste seems to give the waste fibers an integrity by holding them together as agglomerates to facilitate processing during reduction and formation of the non-woven web. No one skilled in the art would deliberately reduce the length of individualized virgin or conventionally reclaimed fibers to 3/16 to ⅜ inch (less than ¾ inch) because (1) longer lengths of these fibers do not cause noils or lumps in the fabric, as in the case of the fiber agglomerates of reduced non-woven waste (accordingly there is no reason for further reducing the fiber length) and (2) decreasing fiber length to this extent would increase the weakness of the fabric, which is undesirable, would increase fiber fallout, which is undesirable, and would require the addition of larger amounts of binder which adds to the expense. On the other hand, in the present invention larger waste sizes do cause lumps (non-uniformity) and the binder is already present in the waste and hence is itself a waste product. It is well known in the non-woven trade that the longer the fiber the better it is. Also, as aforesaid, the presence of the binder during processing of the waste and during web formation seems to facilitate such processing and to reduce fallout and reduction in web strength which would ordinarily occur with such small size individual fibers. Another surprising thing about the invention is that a uniform, non-lumpy, non-woven fabric, having the appearance, feel, strength and other properties of conventional non-woven textile fabrics and containing amounts of binder normal to conventional non-woven fabrics, can be made with a large percentage of waste fiber agglomerates (i.e., pieces of fabric formed from agglomerates of fibers). Another surprising thing is that such pieces become uniformly interwoven with the individualized waste fibers and the longer added fibers to provide an acceptable fabric strength.

Although a non-woven fabric made up of 100% reduced non-woven waste has reduced strength, a dry-laid or wet-laid fabric acceptable for some limited uses can be made of it.

Also, the reclaimed reduced waste can be used for purposes other than making fabric. Since it is a fluffy mass of individualized fibers and small fiber agglomerates, which has the appearance of cotton batting, and has a relatively low bulk density, it can be used as a stuffing for pillows or mattresses, for diapers (it has a high water absorbtion capacity and rate) etc.

Fabric strength depends on (1) the amount of the longer virgin or conventionally reclaimed fibers — the greater the amount the greater the strength, (2) the length of such fibers — the greater the length the greater the strength, (3) the amount of reduced short waste particles — the smaller the amount the greater the fabric strength, (4) the size of smaller reduced waste fibers — the greater the size the greater the fabric strength consistent with not increasing the size to a point where the resulting fabric is not uniform, (5) the amount of binder — the greater the amount the greater the strength consistent with the fact that too much binder resin reduces the quality of the final fabric and (6) the type of binder — some are more adhesive than others.

In the last analysis, the minimum and maximum sizes and amounts of the reduced waste and the minimum and maximum sizes and amounts of the longer fibers added thereto can be readily determined by observing the strength of the fabric which is formed, the uniformity of such fabric, i.e., the noil population and size of the noils and the amount of particles falling out of the web during such formation. If the noil or lump population or size is too great, the size of the reduced waste should be decreased. If the fabric is too weak with a maximum amount of binder for the non-woven properties desired, then the ratio of reduced waste to longer virgin fibers should be decreased, or a longer virgin fiber should be used or the particle size of the reduced fibers can be increased up to a point without creating unacceptable non-uniformities.

Many of the anti-static agents are ionizable compounds ionically conductive (to prevent build-up of static electricity) in the presence of moisture or water. Accordingly, they are usually used in aqueous solutions. The presence of sufficient water alone provides sufficient conductance to serve as an anti-static agent providing the binder or fiber is capable of ionization. Most fibers do not absorb sufficient water and do not ionize sufficiently to provide sufficient anti-static properties in the presence of water.

The conventional resin binder solutions and dispersions which may be used in the process of the invention usually contain, in addition to the dissolved or dispersed binder, fillers of various types.

Where a resin binder fixing bath is used, it may be followed by an aqueous zinc chloride solution bath followed by a water wash bath followed by squeezing, followed by heat drying and heat activation (softening and coalescing) of the thermoplastic resin binder.

The wool or other scaly or rough surfaced fibers with high coefficient of friction added to the reduced waste and longer virgin fibers, increase cohesion of the fabric by better holding the fibers together. Most animal fibers have a relatively high coefficient of friction, as well as synthetic acrylic fibers.

Preferably the longer virgin or conventionally reclaimed fibers are of the same synthetic materials as the waste but they need not be.

The size of the reduced waste dictates the degree of disintegration of the fabric pieces and the degree of separation or individualizing of the waste fibers. The smaller the particles the more the disintegration of the fabric pieces and the more the individualization of the fibers and the greater the reduction in adhesive effect of the binder holding the fibers together, whereas the greater the size of the particles the less the individualization of the fibers and hence the greater the agglomerates of waste fibers held together by the binder.

The weakness of the web caused by reducing the size of the waste particles too much or by too little longer virgin fibers of shorter lengths can be offset to some extent by increasing the binder but this adds to the cost and reduces fabric quality. In this respect one of the surprising features of the invention is that good fabric strength is achieved with small pieces of reduced waste without the necessity of large amounts of binder beyond the amounts in conventional non-woven fabrics. It should be understood that if sufficient binder is used even very short virgin fibers (also flour) can be held together but the result is more like a sheet of plastic with a fiber filler rather than a non-woven fabric.

One particular manufacturer of non-woven fabric generates 3,000,000, pounds of waste per year for dumping. This can be generated into 24,000,000 yards of useful non-woven fabric in accordance with the invention at only a fraction of the cost of the fabric from which the waste was generated while at the same time pollution is decreased by 3,000,000 pounds.

EXAMPLE

Waste non-woven fabric pieces containing nylon-rayon-acetate fibers bound by 30% by weight acrylic resin adhesive, are cut in a Sprout-Waldron BT8-6 Blow Through Cutter to pieces from 1½ to 2 inches in size followed by a Sprout-Waldron MR 20 × 30 knife cutter which further cuts the waste into pieces having a particle size in the order of ¾ to 1 inch. On entry into the first cutter the pieces are sprayed with the Sulfol 448 and Antistate 575 aqueous solution referred to above in an amount equal to 1.5% (this can range from about 1–12%) based on dry weight of the fibers, to give an anti-static content of 0.2% by weight of the fibers. The cut waste was then further reduced in the Sprout-Waldron CG hammer mill to a particle size range of 3/16 inch to ⅜ inch. This material was then blended with 8% virgin nylon and rayon fibers and ½% wool fibers and formed into a dry-laid non-woven web in a Rando Webber. Without further addition of adhesive resin, the web was passed through heating rolls at 120°F to activate the binder in the waste. The resulting non-woven fabric was flexible and strong and highly absorbent of liquids.

While particular embodiments of the present invention have been shown and described, it will be obvious to those skilled in the art that changes and modifications may be made without departing from this invention in its broader aspects. Therefore, it is intended that the specification be interpreted as illustrative only, and not in any limiting sense.

I claim:

1. A method of preparing a non-woven textile fabric from non-woven textile fabric waste which contains a thermoplastic binder resin, comprising cutting the non-woven textile fabric waste to a particle size of about ¾ inch to 1 inch in a first stage, hammer milling said cut waste to a size of about 3/16 inch to ⅜ inch in a second stage, blending said reduced waste with textile fibers of fiber length greater than ¾ inch, and forming the resulting blend into a non-woven web.

2. The method of claim 1, said non-woven web containing a binder which comprises the thermoplastic binder resin from said waste.

3. The method of claim 1, wherein said blend is formed into a non-woven web which is subjected to heat to cause said binder to flow and thereby bind together said fibers.

4. A method according to claim 1, said waste being of non-woven synthetic fibers.

5. A method according to claim 1, wherein said waste is reduced in size by first cutting it and then hammering the cut waste while it is wetted with a textile anti-static and lubricant agent.

6. A method according to claim 5, the amount of anti-static agent being between about 0.1 to 2% by weight of the dry waste.

7. A method according to claim 5, wherein said hammered waste is forced through a screen, the surface of which is of a material having a low coefficient of friction to prevent plugging of said screen and wherein a jet of compressed air is directed against said screen to clean it and cool the hammered fibers.

8. A method according to claim 1, wherein the lower end of said range is about 2/32 inch.

9. The method of claim 8, in which the non-woven fabric waste is 60–98% by weight of the finished non-woven web.

10. The method of claim 8 in which the non-woven fabric waste is reduced to a particle size range of about 3/16 inch to ⅜ inch.

11. The method of claim 10 in which said waste is wetted with a textile lubricant and anti-static agent while it is being reduced in size.

12. The method of claim 10, wherein said waste is reduced in size by hammer milling it and forcing the hammered waste through a screen, and wherein compressed air is directed against said screen while the material is being hammered and forced through said screen.

13. The method of claim 10 in which said reduced material is further blended with scaly fibers having a high coefficient of friction in the amount of about 0.01 to 5% by weight based on the total weight of said combined fibrous material.

* * * * *